US005454021A

United States Patent [19]

Nakajima et al.

[11] Patent Number: 5,454,021

[45] Date of Patent: Sep. 26, 1995

[54] X-RAY MIRROR AND MATERIAL

[75] Inventors: Kunio Nakajima; Shuzo Sudo, both of Tokyo, Japan

[73] Assignee: Seiko Instruments, Inc., Tokyo, Japan

[21] Appl. No.: 149,351

[22] Filed: Nov. 9, 1993

[30] Foreign Application Priority Data

Nov. 12, 1992 [JP] Japan ..... 4-302556

[51] Int. Cl.[6] ..... G21K 1/06

[52] U.S. Cl. ..... 378/84; 378/85; 378/70

[58] Field of Search ..... 378/70, 84, 85, 378/145, 71

[56] References Cited

U.S. PATENT DOCUMENTS 5,077,766 12/1991 Schwenke et al. ..... 378/44
5,239,566 8/1993 Nakamura et al. ..... 378/84

FOREIGN PATENT DOCUMENTS 0128026 12/1984 European Pat. Off. .
63-266398 11/1988 Japan .
1094300 4/1989 Japan .
1309000 12/1989 Japan .

OTHER PUBLICATIONS

Haelbich, Rolf–Reter, "Smooth Multilayer Films Suitable For X–Ray Mirrors", Appl. Phys. Lett 34 (3), 1 Feb. 1, 1979.
Green, M. et al., "Scanning Tunneling Miroscopy of X–Ray Optics", pp. 429–430.
Nakajima, Kunio, et al., "Characteristics of Platinum–Palldium Alloy Film For X–Ray Mirrors", Jpn. J. Appl. Phys. vol. 32 (1993) pp. 1275–1278, Part 1. No. 3A, Mar. 1993.
European Search Report, dated May 27, 1994, Appl. No. EP 93 30 8928.

*Primary Examiner*—Constantine Hannaher
*Assistant Examiner*—Don Wong
*Attorney, Agent, or Firm*—Spensley Horn Jubas & Lubitz

[57] ABSTRACT

An x-ray mirror material of high reflectance with a surface roughness which is very small and a high film density, the material being a Pt alloy film provided as a mirror surface for reflecting x-ray radiation. The composition of the mirror material is expressed by the general formula: $Pt_{1-x}M_x$. This material is deposited on a substrate surface which has been polished to a level form, where M is at least one substance selected from Mo, Ru, Rh, Pd, Ta, W, and Au, and x satisfies the formula: $0.005 \leqq x \leqq 0.10$.

4 Claims, 3 Drawing Sheets

X-RAY MIRROR AND MATERIAL

BACKGROUND OF THE INVENTION

This invention relates to an x-ray mirror and material such as a total reflection mirror and a multilayer mirror reflective in the x-ray wavelength region.

In a catoptric system wherein the wavelength of the x-ray region, 0.1 Å to 200 Å, is employed, a total reflecting mirror, a multilayer mirror, and so on are used depending on the use and the wavelength. If radiation is incident at a small oblique angle, the mirror of the catoptric system has an increased area and on the other hand the mirror of an optical system for a focusing and an imaging mirror has a reduced aperture and thereby an increased aberration. Therefore, it is preferable that the critical angle of x-ray radiation to the mirror surface in total reflection be large.

As regards reflecting material, high density substances such as Au and Pt are used because the critical angle of total reflection is in proportion to the density of the reflecting material. Au and Pt are chemically quite stable, and are thereby utilized for the reflecting surface because of the excellence of their reflecting property. In these reflecting mirrors, materials such as Au and Pt are deposited on a surface of a support substrate made of a material such as quartz glass, monocrystalline silicon, and SiC which can be polished to a very level form, by physical or chemical vapor deposition such as vacuum deposition and sputtering, or plating.

X-rays have a short wavelength, which is about 1/10–1/1000 of that of visible light. So, in order to obtain highly efficient reflectance in this wavelength region, the roughness of the reflecting surface and of the interface with the reflecting material support substrate must be reduced to about 1/10–1/1000 of that for visible light. Also in a substrate, such as one made of quartz glass, polished to have a level surface, the roughness of the film surface could be increased during deposition. Particularly, substances such as Pt and Au are low in Debye temperature and thereby the mobility of atoms at room temperature is large. As a result, crystal grains grows during vacuum deposition and sputtering, which will cause the roughness of the surface to increase. Further, a film 100–1000 Å thick is deposited to form a total reflecting mirror. The film thickness of one layer of a multilayer mirror is between 10 Å and 100 Å. If the film is formed by the above-mentioned method, the density of the film tends to be reduced by about 5–30% as compared to that of a bulk material with the above film thickness. Therefore, x-ray reflecting performance can not be sufficiently obtained.

SUMMARY OF THE INVENTION

An object of the present invention is to reduce the surface roughness of a Pt film formed by the above deposition method and provide a reflecting material for an x-ray mirror which has a density almost equal to that of a pure Pt film, which is superior in reflecting property and which is chemically stable.

The above and other objects are achieved, according to the present invention, by providing a reflecting material constituted by a film of an alloy whose composition is expressed by the general formula $Pt_{1-x}M_x$, for a mirror surface of an x-ray mirror so as to reduce the surface roughness without significantly reducing the film density.

However, M is one or more of the following substances;

Mo, Ru, Rh, Pd, Ta, W, and Au. Preferably, x satisfies the equation; $0.005 \leqq x \leqq 0.10$. If x is expressed as a percentage, then x is between 0.5% and 10% and the formula is expressed as $Pt_{100-x}M_x$.

When M, as defined above, is added to Pt in a proportion of 0.5–10%, the crystal grain size of an alloy film according to the present invention becomes much smaller than that of a conventional pure Pt film. Further, dispersion of the crystal grain size and surface roughness both decrease. However, the film density does not decline significantly since the quantity of the additive is small. Hence, x-ray reflecting performance is improved.

If M is added in a total proportion of more than 10%, surface roughness increases and film density decreases. Consequently the x-ray reflecting performance declines.

DESCRIPTION OF THE PREFERRED EMBODIMENTS

Hereinafter, the present invention will be described with reference to preferred embodiments.

(Embodiment 1)

A Pt-Pd film used for an x-ray mirror material of the present invention can be deposited by the following method. Deposition for this embodiment is performed by sputtering. However, many other deposition technique can be also utilized. In the present invention, both a monocrystalline silicon and a BK7 glass are employed for a substrate; however, other materials polished to have a very level surface can be also used. When the sputtering is performed, the substrate temperature is kept at almost room temperature.

This embodiment employs a Pt-Pd film used for a total reflecting mirror in the x-ray wavelength region of 0.7–2 Å. As for the target which serves as a source of sputtered material, a composite target in which a Pd chip is disposed on a Pt target is used so as to control precisely the quantity of Pd. The film thickness of the Pt-Pd alloy film is 500 Å. Pd content is adjusted to be between 1 atomic percent and 10 atomic percent.

Conventionally, the crystal grain size of a pure Pt film is between 100 Å and 500 Å and the individual crystal grains have differing sizes. The average size is 200 Å. On the other hand, the crystal grain size of a Pt-Pd alloy film to Which Pd is added at 1–2 atomic percent is between 50 Å and 150 Å. In other words, a comparatively small crystal grain size can be obtained. Further, the dispersion of the crystal grain size can be reduced. The average crystal grain size is about 90 Å. The upper limit of Pd is 10 atomic percent for reducing grain size dispersion and crystal grain size.

Figure 1:
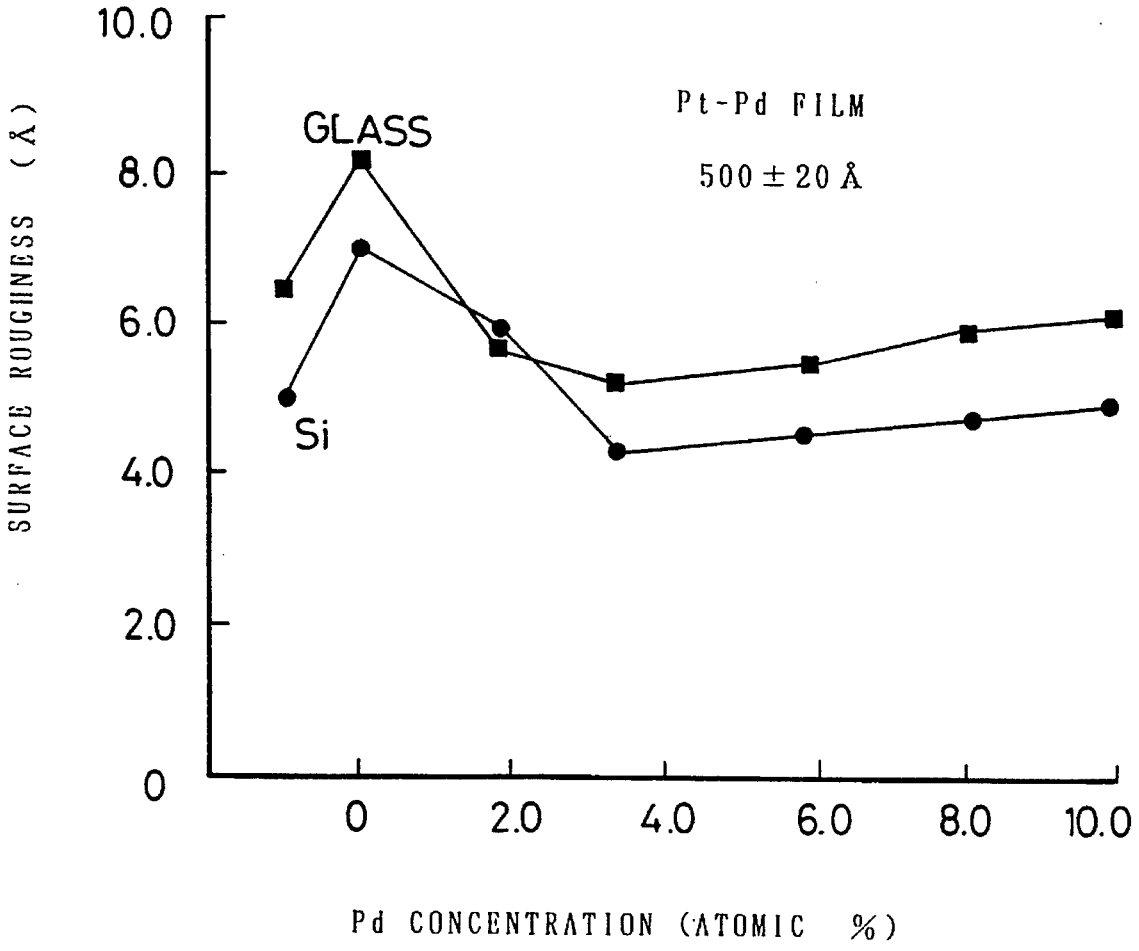
FIG. 1 is a graph showing relations between the surface roughness and the Pd concentration in a Pt-Pd alloy film according to the invention both on a glass substrate and a Si substrate.

FIG. 1 is a graph showing relations between the quantity of Pd in a film according to the invention and rms (root mean square) surface roughness of the resulting reflecting surface. Adding Pd reduces considerably the surface roughness as compared to a pure Pt sputtering film. The same effect can be obtained with monocrystalline silicon and a BK7 glass substrate. The Pd content at which the surface roughness of a Pt-Pd alloy film becomes a minimum is 3–4 atomic percent. The left-hand end of each curve indicates the surface roughness of the substrate prior to deposition of the reflecting film.

Figure 2:
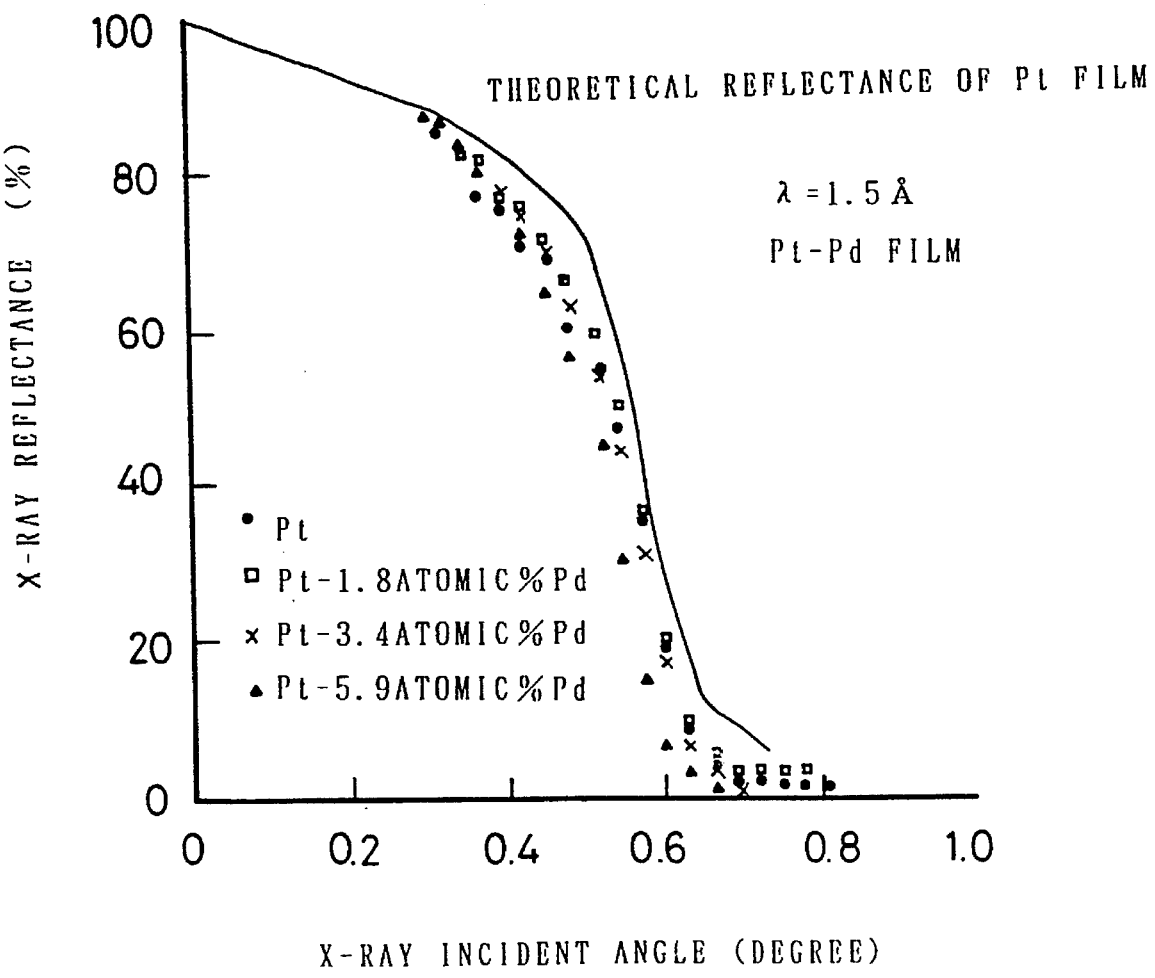
FIG. 2 is a graph showing curves of x-ray reflectance of the inventive Pt-Pd alloy film with CuK α x-ray incident angle.

FIG. 2 is a graph showing x-ray reflectance measured by a CuK α X ray (wave length; 1.54 Å). The solid-line curve shows theoretical reflectance when a Pt film has an ideal surface (roughness=0) and has a density equal to the bulk state of Pt. As shown in FIG. 2, the measured x-ray reflectance actually is smaller than the theoretical reflectance. This is due to surface roughness and Pt film density lower than that of the bulk state Pt. Most of Pt-Pd alloy films to which Pd is added can present a higher reflectance than that of a pure Pt film at an oblique incidence angle less than 0.5°.

On the other hand, the critical angle of total reflection deteriorates because adding Pd at more than about 3 atomic percent reduces the film density considerably. As long as Pd is added at less than 3 atomic percent, the density of the Pt-Pd film is almost the same value as a pure Pt film. Further, a higher reflectance than a pure Pt film can be achieved.

A $Pt_{1-x}M_x$ film deposited as described above can also bring the same effect when M is another one of the substances cited above: Mo, Ru, Rh, Ta, W and Au.

(Embodiment 2)

Based on the results obtained for Embodiment 1, an x-ray multilayer mirror having high reflectance can be produced utilizing an alloy film of a composition expressed by the general formula $Pt_{1-x}M_x$, where M represents one or more substances of Mo, Ru, Rh, Pd, Ta, W, and Au, and x satisfies the following formula: $0.005 \leqq x \leqq 0.10$.

The x-ray multilayer mirror is constituted by a combination of high density metal and low density material, wherein approximately 10–200 layers are laminated and each layer has a thickness of 10–100 Å. The x-ray multilayer mirror is produced by vacuum deposition.

The following two multilayered films were produced: One is composed of one or several layers of an alloy composed of Pt and one or several layers of carbon, C; the other is composed of one or several layers of an alloy composed of Pt containing 1 atomic percent of Pd and one or several layers of C. The thickness of each layer is 25 Å.

Figure 3:
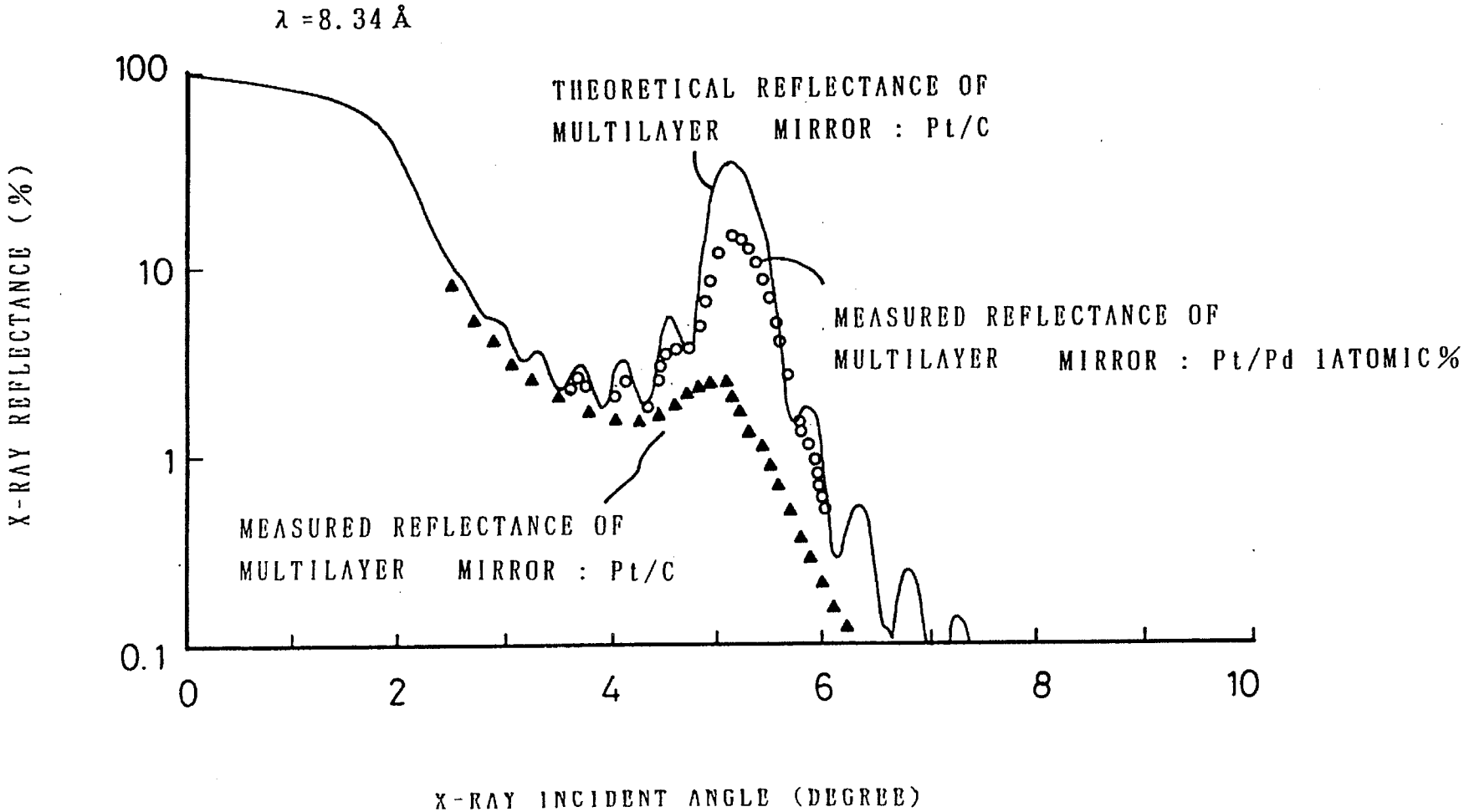
FIG. 3 is a graph showing curves of x-ray reflectance of a multilayered x-ray mirror comprising a combination of a Pt-Pd alloy film according to the invention and a carbon film.

FIG. 3 is a graph showing x-ray reflectance of a Pt/C X-ray multilayer mirror and a Pt containing Pd at 1 atomic percent/C X-ray multilayer mirror which is measured with an AlK α X ray (wavelength: 8.34 Å). As shown in FIG. 3, the peak x-ray reflectance for a reflector formed from Pt/C films is between 2% and 3%. If a multilayered film comprising Pt and C had an ideal surface and an ideal interface (roughness=0) and is equal to the bulk state in density, theoretical reflectance of the Pt/C X-ray multilayer mirror is 32%. The difference between actual reflectance and ideal reflectance is caused by surface and interface roughness and the decrease of a film density. In the produced Pt/C X-ray multilayer mirror, it can be estimated that the rms surface roughness and the interface roughness is between 4.5 Å and 5.5 Å and that the film density of Pt and C is approximately 80% of the density in a bulk state.

On the other hand, for the x-ray multilayer mirror comprising the combination of Pt containing Pd at 1 atomic percent and C, peak reflectance is about 15% and the roughness of the film surface and the interface is 2.5–3 Å. Even if the thickness of one layer of a multilayered film is between 10 Å and 100 Å, similar effect can be obtained for reducing the roughness of the film surface and the interface. FIG. 3 relates to a multilayered film comprising a combination of Pt containing Pd at 1 atomic percent and C as an example. However, similar effect can be gained as long as an alloy film expressed by the general formula $Pt_{1-x}M_x$ constitutes one element of a combination constituting a multilayered film, where M represents one or more of the substances Mo, Ru, Rh, Pd, Ta, W, and Au, and x satisfies the formula: $0.005 \leqq x \leqq 0.10$.

(Embodiment 3)

In Embodiment 1, the crystal grain size is miniaturized in order to reduce surface roughness. In Embodiment 3, an alloyed amorphous film is employed for reducing the surface roughness. A diffraction peak to an x-ray cannot be seen in an alloy film expressed by the general formula $Pt_{1-x}M_x$ so that the above alloy film is an amorphous film, where M represents one or more of Mo, Ru, Rh, Pd, Ta, W and Au, and x satisfies the formula: $0.005 \leqq x \leqq 0.10$.

This application relates to subject matter disclosed in Japanese Application, number 4-302556, filed on Nov. 12, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An x-ray mirror for reflecting x-ray radiation comprising a reflecting material formed on a substrate and comprising Pt and at least one substance selected from Mo, Ru, Rh, Pd, Ta, W and Au, wherein the reflecting material has an atomic composition expressed by a general formula $Pt_{1-x}M_x$, wherein M represents the substance and the value x satisfies the formula: $0.005 \leqq x \leqq 0.10$.

2. An x-ray mirror for reflecting x-ray radiation comprising a reflecting material formed on a substrate and made of an alloy having an average grain size under 150 Å.

3. An x-ray mirror according to claim 2, the alloy has an atomic composition expressed by a general formula $Pt_{1-x}M_x$, wherein M is at least one substance selected from Mo, Ru, Rh, Pd, Ta, W and Au and the value x satisfies the formula: $0.005 \leqq x \leqq 0.10$.

4. An x-ray reflecting material for reflecting x-ray radiation comprising Pt and at least one substance selected from Mo, Ru, Rh, Pd, Ta, W and Au, wherein said x-ray reflecting material has an atomic composition expressed by a general formula $Pt_{1-x}M_x$, wherein M represents the substance and the value x satisfies the formula: $0.005 \leqq x \leqq 0.10$.

* * * * *